United States Patent [19]

Gartner

[11] Patent Number: 4,619,091

[45] Date of Patent: Oct. 28, 1986

[54] CURTAIN WALL CONSTRUCTION HAVING PANEL SUPPORT DEVICE

[75] Inventor: Karl Gartner, Gundelfingen, Fed. Rep. of Germany

[73] Assignee: Yoshida Kogyo K. K., Tokyo, Japan

[21] Appl. No.: 517,008

[22] Filed: Jul. 25, 1983

[30] Foreign Application Priority Data

Aug. 2, 1982 [JP] Japan ..... 57-117546[U]

[51] Int. Cl.[4] ..... E04B 2/00

[52] U.S. Cl. ..... 52/235; 52/487; 52/775; 52/788; 52/398

[58] Field of Search ..... 52/235, 397, 398, 399, 52/400, 487, 732, 775, 486, 788; 49/DIG. 1, DIG. 2

[56] References Cited

U.S. PATENT DOCUMENTS

| | | | |
|---|---|---|---|
| 1,639,711 | 8/1927 | Strachota | 52/487 X |
| 2,859,493 | 11/1958 | Matschke | 52/202 |
| 2,976,970 | 3/1961 | Toney | 52/235 |
| 2,994,415 | 8/1961 | Halle | 52/487 X |
| 3,340,654 | 9/1967 | Maier | 52/235 |
| 4,214,409 | 7/1980 | Gebhardt et al. | 52/648 X |
| 4,428,171 | 1/1984 | Harbin | 52/398 |

FOREIGN PATENT DOCUMENTS

| | | | |
|---|---|---|---|
| 660453 | 1/1965 | Belgium | 52/400 |
| 649042 | 9/1962 | Canada | 52/788 |

*Primary Examiner*—William F. Pate, III
*Assistant Examiner*—C. Dennison
*Attorney, Agent, or Firm*—Hill, Van Santen, Steadman & Simpson

[57] ABSTRACT

A device, for supporting a heavyweight panel in a curtain wall unit or partition having a rectangular frame, comprises a horizontal support plate adapted to support the panel at its lower edge thereof, and a vertical plate extending downwardly and centrally from the horizontal support plate. At least one projection is disposed on the underside or upper side of the horizontal support plate adjacent to an interior edge thereof for being fitted in at least one opening in an interior part of a lower horizontal frame member. The device also may have a plurality of parallel first reinforcing ribs on an interior face of the vertical plate and a plurality of parallel second reinforcing ribs on an exterior face of the vertical plate. Each of the first reinforcing ribs have an interior face lying at a right angle with respect to the underside face of the horizontal support plate for intimate contact with an exterior vertical wall of the interior frame member part when the projection is fitted in the opening in the same interior frame member part. In another form, the first reinforcing ribs are ommitted, and the projection is upwardly directed.

1 Claim, 7 Drawing Figures

CURTAIN WALL CONSTRUCTION HAVING PANEL SUPPORT DEVICE

BACKGROUND OF THE INVENTION

1. Field of the Invention

The present invention relates to a device for supporting a panel at a lower edge thereof in a non-loadbearing wall such as curtain wall or partition.

2. Prior Art

In the field of curtain walls and partitions, in order to effect an improved degree of thermal insulation, it is customary to use, as a panel, a double-pane of glass or a thermally-insulated board, either of which is heavy in weight and hence necessitates a suitable supporting means.

FIG. 1 of the accompanying drawings illustrates a known construction, for bearing the load of such a heavy panel 1, comprising a horizontal support plate 2 projecting exteriorly from the interior part 3A of an interior lower frame member (of a curtain wall unit). However, this support plate 2 would often serves as an obstacle in assembling a curtain wall or partition. Further, in production the support plate 2 is formed integrally with the interior lower frame member 3A as the latter is formed by extrusion; however giving the support plate 1 a sufficient degree of structural strength is wasteful of material.

Another known support construction, as shown in FIG. 2, comprises a block 2' fixed to the interior part 3A' of the lower frame member by means of a bolt or screw 4; the load of the heavy panel 1 is borne primarily by the screw 4. With this arrangement it is difficult to fasten the screw 4 with adequate firmness, causing infirm attachment of the block 2' and thus unstable supporting of the panel 1. In FIGS. 1 and 2, a gasket 6 is carried by the interior part 3A, 3A' of the lower frame member.

SUMMARY OF THE INVENTION

According to the present invention, a panel supporting device, for a curtain wall unit or partition having a rectangular frame, comprises a horizontal support plate adapted to support a heavyweight panel at its lower edge thereof, and a vertical plate extending downwardly and centrally from the horizontal support plate. At least one projection is disposed on the underside of the horizontal support plate adjacent to an interior edge thereof for being fitted in at least one opening in an interior part of a lower horizontal frame member. The device also has a plurality of parallel first reinforcing ribs on an interior face of the vertical plate and a plurality of parallel second reinforcing ribs on an exterior face of the vertical plate. Each of the first reinforcing ribs has an interior face lying at a right angle with respect to the underside face of the horizontal support plate for intimate contact with an exterior vertical wall of the interior frame member part when the projection is fitted in the opening in the same interior frame member part. In another form, the first reinforcing ribs are omitted and the projection is upwardly directed.

It is therefore an object of the invention to provide a panel supporting device for a curtain wall or partition, which has an improved degree of structural strength sufficient to support a heavyweight panel stably and properly.

Another object of the invention relates to a panel supporting device, for a curtain wall or partition, which enables the curtain wall or partition to be assembled and installed easily and accurately.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION

Figure 1:
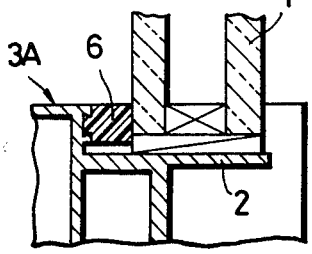
FIG. 1 PRIOR ART
FIG. 1 is a fragmentary cross-sectional view of a curtain wall, showing a prior panel-supporting construction.
Figure 2:
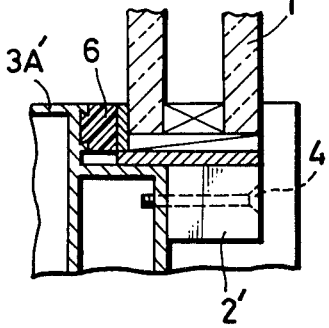
FIG. 2 PRIOR ART
FIG. 2 is a fragmentary cross-sectional view similar to FIG. 1, showing another prior panel-supporting construction.
Figure 3:
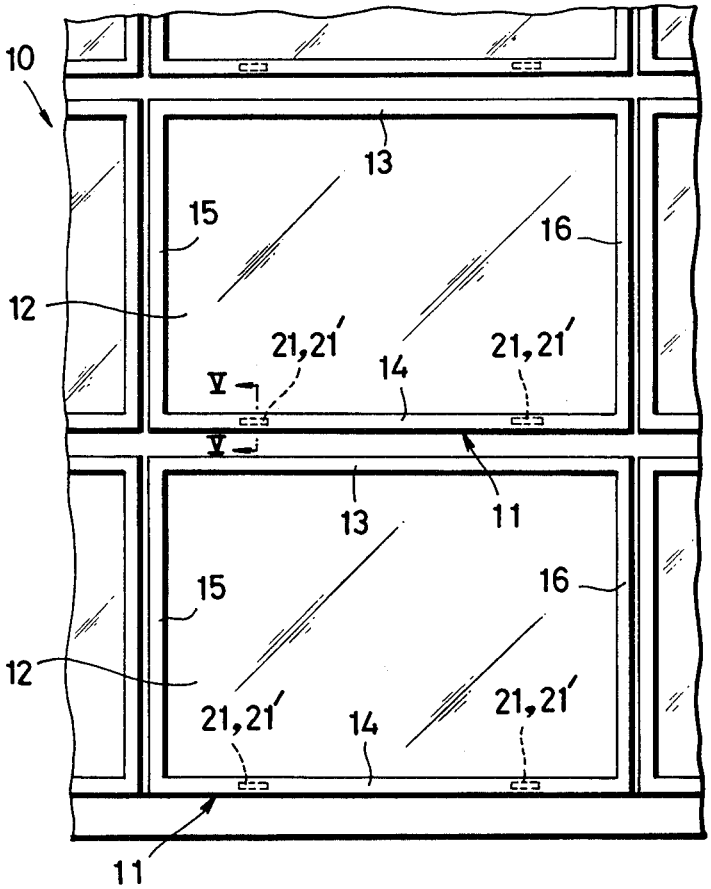
FIG. 3 is a fragmentary rear elevational view of a curtain wall having been assembled by using a plurality of panel supporting devices embodying the present invention.

FIG. 3 fragmentarily shows a curtain wall 10 in which a plurality of curtain wall units 11 is arranged in a checkerboard pattern so as to cover an exterior building wall (not shown), each of the curtain wall units 11 being fixed to a building's skeleton framework (not shown) by a suitable fastener means (not shown).

Figure 5:
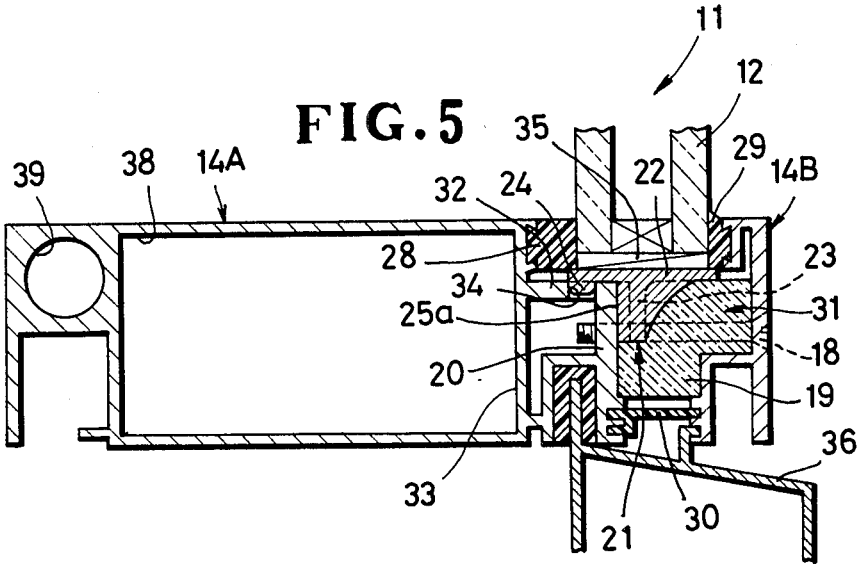
FIG. 5 is an enlarged cross-sectional view taken along line V—V of FIG. 3, showing the manner in which a panel is supported by the device of FIG. 4.

Each curtain wall 11 includes a panel 12, in the form of a double-pane of glass which is heavy in weight, and a rectangular frame extending around a periphery of the panel 12. The rectangular frame comprises a pair of upper and lower horizontal frame members 13, 14 of metal and a pair of vertical side frame members 15, 16 of metal connected to the upper and lower horizontal frame members 13, 14 at their ends. As shown in FIG. 5, each of the four frame members 13, 14, 15, 16 (only the lower horizontal frame member 14 is shown in FIG. 5 for clarity) includes an interior part 14A of hollow cross section, and an exterior part 14B connected to the interior part 14A by a plurality of bolts or screws 18 (only one screw is shown) extending through the exterior part 14B, through a thermal insulator 19, and through a first exterior vertical wall 20 of the interior part 14A.

Figure 4:
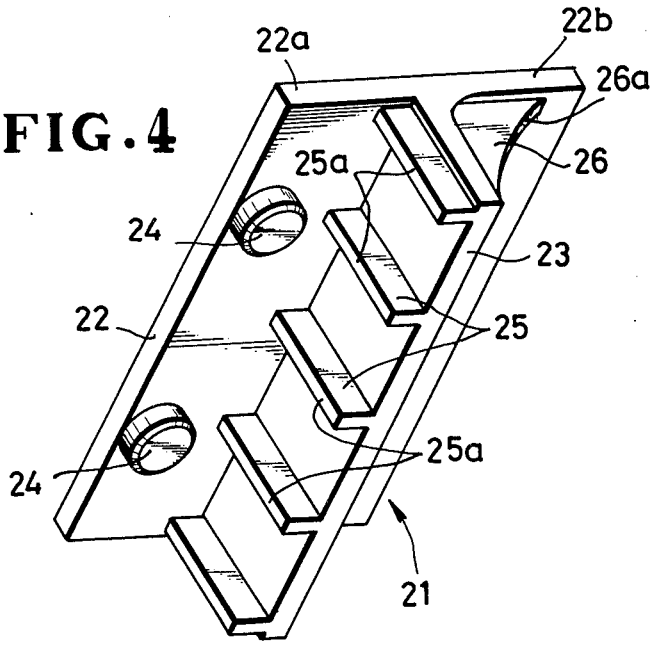
FIG. 4 is an enlarged perspective view of one of the panel supporting devices shown in FIG. 3.

The panel 12 is supported at its lower edge by a pair of supporting devices 21, 21 of metal disposed between the interior and exterior parts 14A, 14B and spaced apart from one another along the lower frame member 14. As best shown in FIG. 4, each supporting device 21 includes a horizontal support plate 22 for supporting the panel 12 at the lower edge thereof, and a vertical plate 23 projecting downwardly and centrally from the underside of the horizontal support plate 22, dividing the latter into interior and exterior halves **22*a*, 22*b*. Thus the supporting device 21 has a T-shaped transverse cross section. The horizontal support plate 22 has a pair of projections 24, 24 disposed on the underside of the interior horizontal plate half 22***a* at positions adjacent to an interior edge thereof, for a purpose described below. Each of the projections 24 is in the form of a solid cylinder.

The supporting device 21 also has a plurality of parallel first reinforcing ribs 25 disposed on an interior face of the vertical plate 23, and a plurality of parallel second reinforcing ribs 26 disposed on an exterior face of the vertical plate 23. Each of the first reinforcing ribs 25 has an interior face 25*a* lying at a right angle with respect to the underside face of the horizontal support plate 22, for a purpose described below. Each of the second reinforcing ribs 26 has a concave edge 26*a* extending from a lower edge of the vertical plate 23 to the underside face of the horizontal support plate 22 and terminating short of an exterior edge of the horizontal support plate 22.

As shown in FIG. 5, the panel 12 is sandwiched at its lower edge between a pair of gaskets 28, 29 carried by the interior and exterior parts 14A, 14B, respectively, of the lower frame member 14. The exterior part 14B and the first exterior vertical wall 20 of the interior part 14A are interconnected to one another at their lower portions by a connecting plate 30 made of hard thermally-insulating material, thus defining an elongated channel 31 between the interior and exterior parts 14A, 14B. An exterior horizontal wall 32 extends between the first exterior vertical wall 20 and a second exterior vertical wall 33 and has a predetemined number of pairs of spaced openings 34 (only one opening is shown), each pair of the openings 34, 34 being receptive of the two projections 24, 24, respectively, of the respective supporting device 21. The openings 34 in the second vertical wall 33 of the interior part 14A may be formed by a drilling machine or a punching machine.

For installation, the supporting device 21 is simply placed on the first exterior vertical wall 20 and the exterior horizontal wall 32, at that time the two projections 24, 24 are fitted in the respective openings 34, 34 in the exterior horizontal wall 32, while the interior faces 25*a* of all the first reinforcing ribs 25 are in intimate contact with the first exterior vertical wall 20. The panel 12 is placed in upright position on the horizontal support plate 22 of the supporting device 21 with a liner 35 interposed therebetween. A flashing 36 is interposed between the adjacent upper and lower curtain wall units 11, 11 in thermally insulated relation to the interior part 14A.

The interior part 14A of the lower frame member 14 has along its mid portion an air flow passage 38, through which the air, conditioned to required temperature and humidity, is circulated, and along its interior edge a heat-medium flow passage 39, through which hot or cold water is circulated to heat or cool the air inside the building.

Because of not only its T-shaped configuration in transverse cross section, but also the first and second reinforcing ribs 25, 26, the supporting device 21 has an improved degree of structural strength sufficient to bear the load of a heavyweight panel.

Another advantage of the supporting device 21 is that it can be mounted on the interior part 14A of the lower frame member 14 with adequate stability, partly because the two projections 24, 24 on the horizontal support plate 22 are fitted in the respective openings 34, 34 in the exterior horizontal wall 32 of the interior part 14A, and partly because the interior faces 25*a* of all the first reinforcing ribs 25 on the vertical plate 23 are in intimate contact with the first exterior vertical wall 20 of the interior part 14A.

Further, the supporting device 21 can be mounted on the interior part 14A of the lower frame member 14 with maximum ease, thus enabling easy and accurate assembly and installation of the curtain wall or partition.

Figure 6:
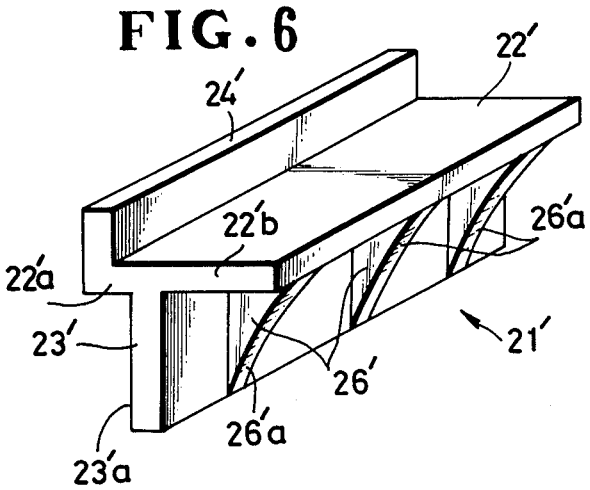
FIG. 6 is a perspective view similar to FIG. 4, showing a modification of the panel supporting device.
Figure 7:
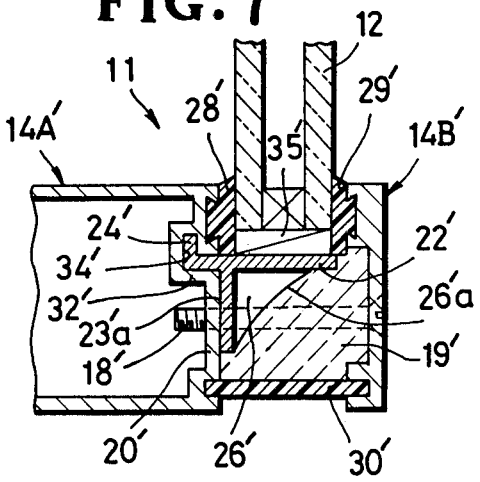
FIG. 7 is a cross-sectional view similar to FIG. 5, showing the manner in which a panel is supported by the modified device of FIG. 6.

FIGS. 6 and 7 illustrate a modified supporting device 21' including a horizontal support plate 22' for supporting the panel 12 at the lower edge thereof, and a vertical plate 23' projecting downwardly from the underside of the horizontal support plate 22', dividing the latter into interior and exterior halves 22'*a*, 22'*b*. Thus the supporting device 21' has a generally T-shaped transverse cross section. The horizontal support plate 22' has a projection 24' in the form of an upwardly directed flange extending along the interior edge of the interior horizontal plate half 22'*a*, for a purpose described below. The supporting device 21' also has a plurality of parallel reinforcing ribs 26' disposed on an exterior face of the vertical plate 23'; each reinforcing rib 26' has a concave edge 26'*a* extending from the lower edge of the vertical plate 23' to the underside face of the horizontal support plate 22' and terminating short of the exterior edge of the horizontal support plate 22'.

As shown in FIG. 7, the panel 12 is sandwiched at its lower edge between two gaskets 28', 29' carried by the interior and exterior parts 14A', 14B', respectively, of the lower frame member 14. The interior part 14A' has an exterior vertical wall 20', an exterior horizontal wall 32', and an opening 34' in the form of an elongated groove having an L-shaped transverse cross section extending along the entire length of the interior part 14A'. The interior and exterior parts 14A', 14B' are interconnected to one another by a plurality of bolts or screws 18' (only one screw is shown) and a connecting plate 30' made of hard thermally-insulating material.

To mount the supporting device 21' on the interior part 14A', the flanged interior half 22'*a* of the horizontal support plate 22' is simply threaded through the L-shaped groove 34' from one of opposite ends of the interior part 14A'. At that time, the interior face 23'*a* of the vertical plate 23' and the underside face of the interior horizontal plate half 22'*a* are in intimate contact with the exterior vertical wall 20' and the exterior horizontal wall 32', respectively. The panel 12 is placed in upright position on the horizontal support plate 22' of the supporting device 21' with a liner 34' interposed therebetween.

Because of not only its generally T-shaped configuration in transverse cross section, but also the reinforcing ribs 26', the supporting device 21' of FIG. 6, like the supporting device 21 of FIG. 4, has an improved degree of structural strength sufficient to bear the load of a heavyweight panel. Further, the supporting device 21' can be mounted on the interior part 14A' of the lower frame member 14 with adequate stability, partly because the flange or projection 24' on the horizontal support plate 22' is fitted in the groove or opening 34' in the interior part 14A' and partly because the interior face 23'*a* of the vertical plate 23' is in intimate contact with the exterior vertical wall 20' of the interior part 14A'. In addition, the supporting device 21' can be mounted on the interior part 14A' with maximum ease by simply threading the flanged interior half 22'*a* of the horizontal support plate 22' through the T-shaped groove 34' in the interior part 14A'.

In any of the embodiments of FIGS. 5 and 7, as many of the supporting devices as required may be installed on the lower frame member 14 of a curtain wall unit 11 to jointly bear the entire load of a single heavyweight panel 12, at which time these supporting devices are preferably spaced apart from one another at uniform intervals along the lower frame member 14.

Although various minor modifications may be suggested by those versed in the art, it should be understood that I wish to embody within the scope of the patent warranted hereon, all such embodiments as reasonably and properly come within the scope of my contribution to the art.

What is claimed is:

1. In a curtain wall construction, a heavyweight panel having (1) an exterior frame and (2) an interior frame connected together, (3) each of said frames including a pair of upper and lower horizontal frame members and a pair of vertical side frame members connected to said horizontal frame members at their ends, (4) said lower horizontal frame member of said interior frame having a vertical plate facing said exterior frame, and a horizontal plate with at least one opening, said horizontal plate being directed toward said exterior frame, the improvement of a support device in combination therewith, said device comprising:

(a) a horizontal support plate supporting said exterior and said interior frames at said lower horizontal frame members;

(b) a vertical plate projecting downwardly and substantially centrally from said horizontal support plate and disposed against said first-named vertical plate of said interior frame; and (c) at least one vertical projection disposed on said horizontal support plate adjacent to an interior edge thereof and extending into said opening in said lower horizontal frame member of said interior frame, said projection comprising a downwardly directed solid cylinder.

* * * * *